US011727881B2

(12) United States Patent
Chen et al.

(10) Patent No.: US 11,727,881 B2
(45) Date of Patent: Aug. 15, 2023

(54) PIXEL CIRCUIT AND DISPLAY PANEL

(71) Applicant: Wuhan China Star Optoelectronics Semiconductor Display Technology Co., Ltd., Wuhan (CN)

(72) Inventors: Yong Chen, Wuhan (CN); Jun Li, Wuhan (CN); Liang Sun, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 600 days.

(21) Appl. No.: 16/957,113

(22) PCT Filed: Apr. 15, 2020

(86) PCT No.: PCT/CN2020/084823
§ 371 (c)(1),
(2) Date: Jun. 23, 2020

(87) PCT Pub. No.: WO2021/184472
PCT Pub. Date: Sep. 23, 2021

(65) Prior Publication Data

US 2023/0121173 A1 Apr. 20, 2023

(30) Foreign Application Priority Data

Mar. 19, 2020 (CN) ..... 202010198216.9

(51) Int. Cl.
*G09G 3/30* (2006.01)
*G09G 3/3241* (2016.01)
(Continued)

(52) U.S. Cl.
CPC ..... *G09G 3/3241* (2013.01); *G09G 3/3266* (2013.01); *G09G 3/3291* (2013.01); *G09G 2300/0876* (2013.01)

(58) Field of Classification Search
CPC .. G09G 3/3208; G09G 3/3233; G09G 3/3225; G09G 3/3241; G09G 3/3266;
(Continued)

(56) References Cited

U.S. PATENT DOCUMENTS

2008/0106504 A1* 5/2008 Wei ..... G09G 3/3233 345/82
2010/0127955 A1* 5/2010 Choi ..... G09G 3/3233 345/76
(Continued)

FOREIGN PATENT DOCUMENTS

CN 110233166 9/2010
CN 102005178 4/2011
(Continued)

*Primary Examiner* — Jennifer T Nguyen
(74) *Attorney, Agent, or Firm* — PV IP PC; Wei Te Chung; Zhigang Ma

(57) ABSTRACT

A pixel circuit and a display panel are provided. The display includes the pixel circuit. The pixel circuit includes a data line, a scan line, a plurality of hierarchical 2T1C circuits, a step-down circuit, and a reset circuit. The data line is configured to transmit a source data signal. The scan line is configured to transmit a scan signal. Each input of the plurality of hierarchical 2T1C circuits is connected to the scan line in parallel. An input of the step-down circuit is connected to the data line and an output of the step-down circuit is connected to another input of each 2T1C circuit. The reset circuit is connected to the input of the step-down circuit.

9 Claims, 7 Drawing Sheets

(51) Int. Cl.
*G09G 3/3266* (2016.01)
*G09G 3/3291* (2016.01)

(58) Field of Classification Search
CPC ..... G09G 3/3275; G09G 3/3291; G09G 2300/0842; G09G 2300/0876; G09G 2310/0251; G09G 2310/0297; G09G 2320/045
USPC ..... 345/76
See application file for complete search history.

(56) References Cited

U.S. PATENT DOCUMENTS

| | | | | |
|---|---|---|---|---|
| 2011/0050741 | A1* | 3/2011 | Jeong ..... | G09G 3/3291 345/82 |
| 2018/0308425 | A1 | 10/2018 | Zhou et al. | |
| 2019/0121476 | A1 | 4/2019 | Jang et al. | |

FOREIGN PATENT DOCUMENTS

| | | |
|---|---|---|
| CN | 105096831 | 11/2015 |
| CN | 105845081 | 8/2016 |
| CN | 107038996 | 8/2017 |
| CN | 109696984 | 4/2019 |
| CN | 109801598 | 5/2019 |
| CN | 110189707 | 8/2019 |
| CN | 110459167 | 11/2019 |
| CN | 110459175 | 11/2019 |
| CN | 110649080 | 1/2020 |
| CN | 110660357 | 1/2020 |
| CN | 110675829 | 1/2020 |
| CN | 110767158 | 2/2020 |

* cited by examiner

PIXEL CIRCUIT AND DISPLAY PANEL

RELATED APPLICATIONS

This application is a National Phase of PCT Patent Application No. PCT/CN2020/084823 having International filing date of Apr. 15, 2020, which claims the benefit of priority of Chinese Patent Application No. 202010198216.9 filed on Mar. 19, 2020. The contents of the above applications are all incorporated by reference as if fully set forth herein in their entirety.

FIELD AND BACKGROUND OF THE INVENTION

The present invention relates to the field of display technologies, and more particularly to a pixel circuit and a display panel.

With the continuous development of science and technology, people have higher and higher requirements for display devices, and the development of display technology has also made rapid progress. Nowadays, a design of "full screen" has become a mainstream of the times, and all screen suppliers are focusing on the development of full screen products with a relatively high screen ratio. Increasing the screen ratio of the display screen has become a product development trend.

At present, many solutions on the market for increasing the screen ratio usually design a front camera on an outside of the display screen. A special-shaped cutting design allows the display to use a certain size to accommodate the front camera. No matter how the cutting design changes, it is far from the full screen concept. Recently, a processing scheme of a light-emitting blind hole screen camera (CUP) can make the display screen almost full-screen effect.

As shown in FIG. 1, which is a schematic structural diagram of an existing under-screen camera display panel. The under-screen camera display panel 90 includes a flexible substrate layer 91, an array substrate 92, a light-emitting layer 93, an encapsulation layer 94, a polarizer 95, and a cover plate 96 stacked in an order from bottom to top. A through hole is provided in a corresponding position of the array substrate 92 and the polarizer 95 to form a blind hole 97. Place a camera 98 below the screen and set it corresponding to the blind hole 97. That is, an area where the blind hole 97 and the camera 98 are located is an area of the camera under the screen. Through an optimization of a panel design and a lens design, a lens can be hidden under a display area of the screen to complete shooting. When the under-screen camera solution is adopted, it is to improve light transmittance of the under-screen camera area. When using a classic 7T1C circuit of organic light-emitting diode (OLED) display, in order to improve the light transmittance of the under-screen camera area, a pixel design needs to be optimized to reduce a pixel density of the under-screen camera area to achieve partial transparency.

Mounting a 2T1C pixel circuit above the under-screen camera area can reduce the pixel density. Due to the small area of the under-screen camera area, the 2T1C pixel circuit has little effect on the display screen. However, an operating voltage of the current 2T1C pixel circuit is not within a normal data voltage range given by a driving circuit, it is not desirable to mount the conventional 2T1C pixel circuit in the under-screen camera area.

In the under-screen camera technology, the most influential factor for imaging is light transmittance of the screen.

Therefore, improving the light transmittance of the under-screen camera area has become an urgent issue to be solved.

SUMMARY OF THE INVENTION

An object of the present invention is to provide a pixel circuit and a display panel, by changing a circuit structure of an under-screen camera area, to achieve a performance of improving light transmittance.

In order to solve the above issues, an embodiment of the present invention provides a pixel circuit comprising a data line, a scan line, a plurality of hierarchical 2T1C circuits, a step-down circuit, and a reset circuit. The data line is configured to transmit a source data signal. The scan line is configured to transmit a scan signal. Each input of the plurality of hierarchical 2T1C circuits is connected to the scan line in parallel. An input of the step-down circuit is connected to the data line and an output of the step-down circuit is connected to another input of each 2T1C circuit. The reset circuit is connected to the input of the step-down circuit.

Further, the reset circuit comprises a first driving transistor comprising a source configured to input a reset voltage signal, a drain connected to another input of each 2T1C circuit, and a gate configured to input an AC voltage signal. When the AC voltage signal is at a low level, a voltage of the reset voltage signal is written into the 2T1C circuit to reset the 2T1C circuit.

Further, the step-down circuit comprises a second driving transistor comprising a source configured to input a source data signal, and a gate and a drain connected to another input of each 2T1C circuit. When the scan signal of the 2T1C circuit is at a low level, a voltage of the source data signal is captured by the second driving transistor after being thresholded to be written into the 2T1C circuit.

Further, timing of the AC voltage signal is set in synchronization with timing of a multiplexer signal.

Further, the pixel circuit further comprises a voltage stabilizing capacitor comprising an end electrically connected to a positive power supply voltage and another end electrically connected to the input of the 2T1C circuit, the voltage stabilizing capacitor is configured to stabilize a voltage input to the 2T1C circuit.

An embodiment of the present invention further provides a display panel comprising the above pixel circuit.

Further, the display panel comprises an under-screen camera area and a display area around the under-screen camera area, the 2T1C circuit is disposed in the under-screen camera area.

Further, the under-screen camera area comprises a plurality of second pixel units arranged along a longitudinal direction, wherein the second pixel unit comprises the 2T1C circuit, each input of the plurality of second pixel units is connected to the scan line, and another input of the plurality of second pixel units is connected to the output of the step-down circuit; and a plurality of first pixel units arranged in the longitudinal direction, wherein the first pixel unit comprises a 7T1C pixel circuit, and an input of the 7T1C pixel circuit is connected to the data line; wherein the plurality of second pixel units arranged in the longitudinal direction and the plurality of first pixel units arranged in the longitudinal direction are arranged at intervals in the horizontal direction.

Further, in the under-screen camera area, a distribution density of the plurality of first pixel units arranged in the longitudinal direction is less than a distribution density of the plurality of second pixels arranged in the longitudinal direction.

Further, the display area comprises a plurality of data lines extending longitudinally and a plurality of first pixel units, the first pixel unit comprises the 7T1C pixel circuit, and the input of the 7T1C pixel circuit is connected to the data line.

Beneficial Effect

Beneficial effect of embodiments the present invention is to provide a pixel circuit and a display panel. By changing a circuit structure of an under-screen camera area, to achieve a performance of improving light transmittance.

Figure 1:
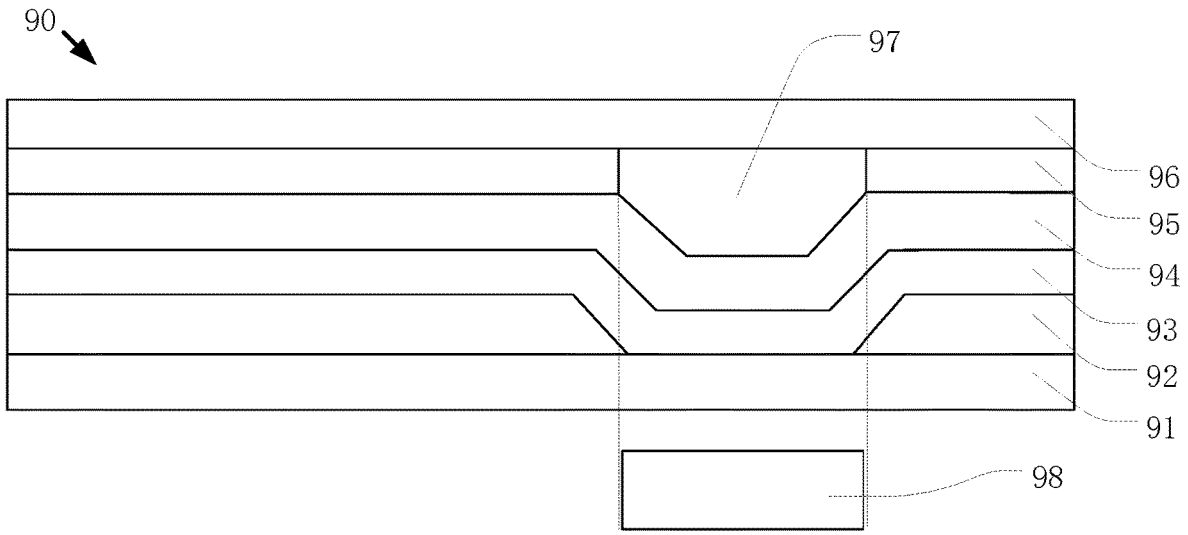
FIG. 1 (Prior Art)
FIG. 1 is a schematic structural diagram of a conventional under-screen camera display panel.

1, data line, 2, source data signal line, 10, under-screen camera area.

11, first pixel unit, 12, second pixel unit, 20, display area. 100, display panel.

DESCRIPTION OF SPECIFIC EMBODIMENTS OF THE INVENTION

The technical solutions in the embodiments of the present application will be described clearly and completely with reference to the drawings in the embodiments of the present application. Obviously, the described embodiments are only a part of the embodiments of the present application, but not all the embodiments. Based on the embodiments in the present application, all other embodiments obtained by those skilled in the art without making creative efforts fall within the protection scope of the present application.

In the present invention, the same or corresponding components are denoted by the same reference numerals regardless of the drawing numbers. Throughout the specification, when the expressions "first", "second", etc. can be used to describe various components, these components are not necessarily limited to the above expressions. The above wording is only used to distinguish one component from another.

In the description of this application, it should be noted that, unless otherwise clearly specified and limited, the terms "installation", "link", and "connection" should be understood in a broad sense. For example, it may be a fixed connection, a detachable connection, or an integral connection. It can be a mechanical connection, an electrical connection, or can communicate with each other. It can be directly connected or indirectly through an intermediary. It can be communication between two elements or interaction between the two elements. Those of ordinary skill in the art can understand the specific meanings of the above terms in this application according to specific situations.

Figure 2:
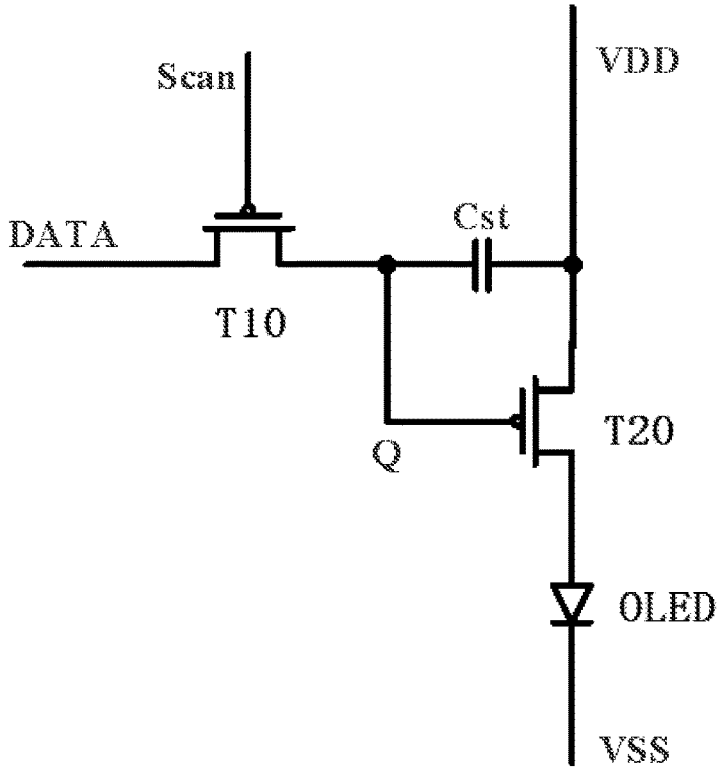
FIG. 2 is a schematic structural diagram of a 2T1C pixel circuit.
Figure 3:
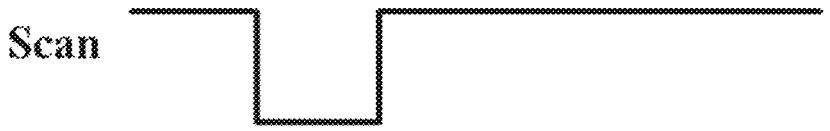
FIG. 3 is a timing diagram of a scan signal Scan in the 2T1C pixel circuit shown in FIG. 2.

FIG. 2 is a schematic structural diagram of a 2T1C pixel circuit. The 2T1C pixel driving circuit includes a first thin film transistor T10, a second thin film transistor T20, a storage capacitor Cst, and an organic light-emitting element OLED. A gate of the first thin film transistor T10 is electrically connected to a scan signal Scan. A timing diagram of the scan signal Scan is shown in FIG. 3. A source of the first thin film transistor T10 is electrically connected to a data signal Data. A drain of the first thin film transistor T10 is electrically connected to a gate of the second thin film transistor T20 and an end of the storage capacitor Cst. A source of the second thin film transistor T20 is electrically connected to a power supply positive voltage VDD, and a drain of the second thin film transistor T20 is electrically connected to an anode of the organic light-emitting diode OLED. A cathode of the organic light-emitting diode OLED is electrically connected to a power supply negative voltage VSS. An end of the storage capacitor Cst is electrically connected to the drain of the first thin film transistor T10. Another end of the organic light-emitting diode OLED is electrically connected to the source of the second thin film transistor T20. During display, the scan signal Scan controls the first thin film transistor T10 to be turned on. The data signal Data enters the gate of the second thin film transistor T20 and the storage capacitor Cst through the first thin film transistor T10. Then the first thin film transistor T10 is turned on. Due to a storage function of the storage capacitor Cst, a gate voltage of the second thin film transistor T20 can still maintain the data signal voltage. This makes the second thin film transistor T20 in an on state. Driving current enters the organic light-emitting diode OLED through the second thin film transistor T20, driving the organic light-emitting diode OLED to emit light.

Figure 4:
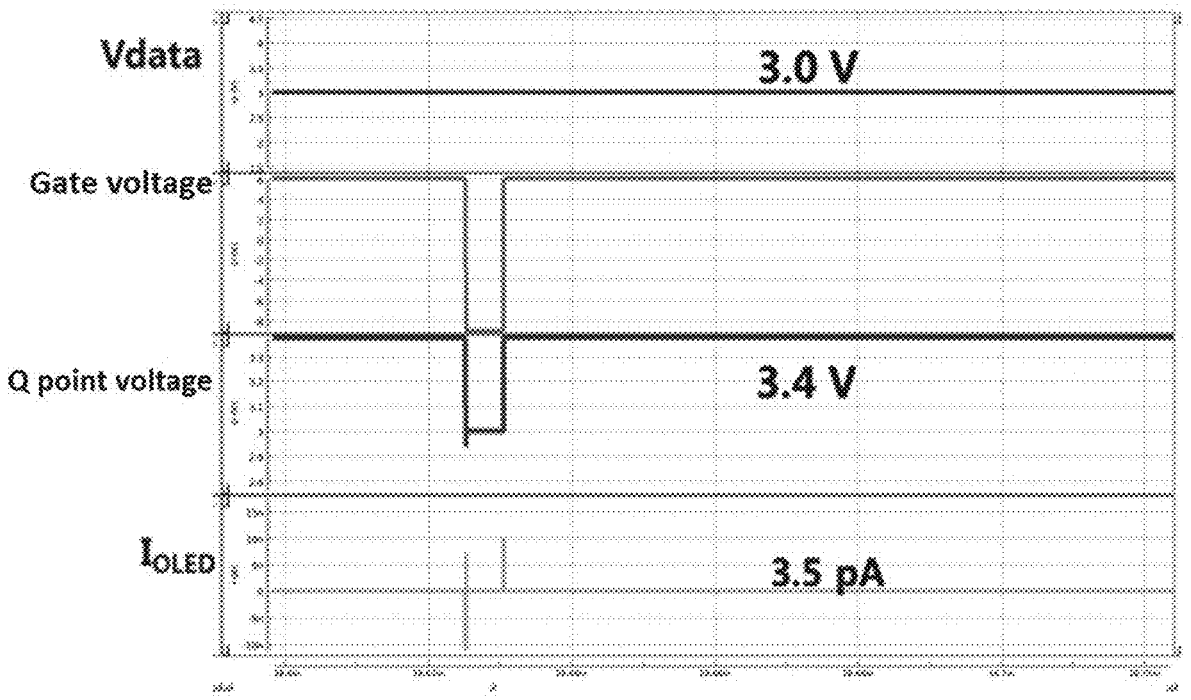
FIG. 4 is a simulation result diagram of the 2T1C pixel circuit shown in FIG. 2.

The 2T1C pixel circuit does not capture a threshold voltage Vth, keeping a size of the thin film transistor and storage capacitor consistent with the classic 7T1C circuit. When the Data voltage written by the first transistor T10 is 3.0V, according to the simulation result in FIG. 4, it can be known that a gate voltage point Q of the second thin film transistor T20 reaches 3.4 V due to connection with the drain of the first thin film transistor T10, so there is no Vth capture of 7T1C circuit. When a writing VDD voltage is 4.6 V and VSS is −4.0 V, for p-type TFTs, gate voltage Vgs=3.4-4.6=−1.2V, which is greater than the threshold voltage Vth (about −2.5V). The second thin film transistor T20 is in an unturned state. Theoretically, current flowing through the organic light-emitting diode is almost zero, which is similar to the simulation result of FIG. 4, $I_{OLED}$=3.5 pA.

Figure 5:
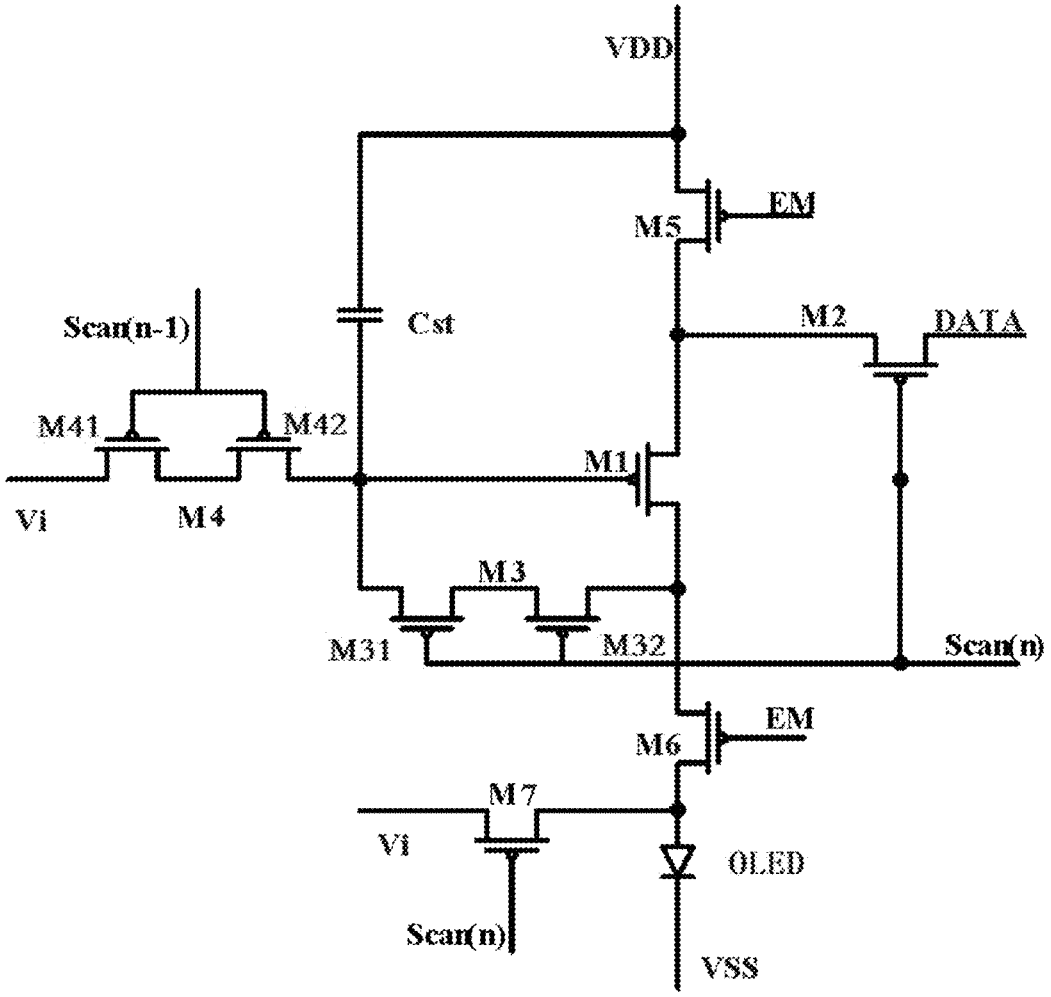
FIG. 5 is a schematic structural diagram of a 7T1C pixel circuit.

As shown in FIG. 5, which is a schematic structural diagram of a 7T1C pixel circuit. The 7T1C pixel circuit includes a first transistor M1, a second transistor M2, a third transistor M3, a fourth transistor M4, a fifth transistor M5, a sixth transistor M6, a seventh transistor M7, a storage capacitor Cst, and an organic light-emitting element OLED.

A gate of the first transistor M1 is connected to a first end of the storage capacitor Cst. A first electrode of the first transistor M1 is connected to a first electrode of the second transistor M2. A second electrode of the first transistor M1 is connected to a first electrode of the third transistor M3. A gate of the second transistor M2 is connected to a second scan signal terminal Scan (n). The second electrode of the second transistor M2 is connected to a data signal terminal Vdata. A gate of the third transistor M3 is connected to the second scan signal terminal Scan (n). A second electrode of the third transistor M3 is connected to a first end of the storage capacitor Cst. A second end of the storage capacitor Cst is connected to the first voltage signal terminal VDD.

A gate of the fourth transistor M4 is connected to a first scan signal terminal Scan (n−1). A first electrode of the fourth transistor M4 is connected to the first end of the storage capacitor Cst. A second electrode of the fourth transistor M4 is connected to an initialization signal terminal Vi. A gate of the fifth transistor M5 is connected to a control signal terminal EM. A first electrode of the fifth transistor M5 is connected to the first voltage signal terminal VDD. A second electrode of the fifth transistor M5 is connected to the first electrode of the first transistor M1. A gate of the sixth transistor M6 is connected to the control signal terminal EM. A first electrode of the sixth transistor M6 is connected to the second electrode of the first transistor M1. A second electrode of the sixth transistor M6 is connected to the anode of the organic light-emitting element OLED. The cathode of the organic light-emitting element OLED is connected to the second voltage signal terminal VSS A gate of the seventh transistor M7 is connected to the second scan signal terminal Scan (n). A first electrode of the seventh transistor M7 is connected to the initialization signal terminal Vi. A second electrode of the seventh transistor M7 is connected to the anode of the organic light-emitting element OLED.

The third transistor M3 includes two sub-transistors connected in series. A gate of the first sub-transistor M31 is connected to the second scan signal terminal Scan (n). A first electrode of the first sub-transistor M31 is connected to a second electrode of the second sub-transistor M32. A second electrode of the first sub-transistor M31 is connected to the first end of the storage capacitor Cst. A gate of the second sub-transistor M32 is connected to the second scan signal terminal Scan (n). A first electrode of the second sub-transistor M32 is connected to the second electrode of the first transistor M1.

The fourth transistor M4 includes two sub-transistors connected in series. A gate of the third sub-transistor M41 is connected to the first scan signal terminal Scan (n−1). A first electrode of the third sub-transistor M41 is connected to the first end of the storage capacitor Cst. A second electrode of the third sub-transistor M41 is connected to a first electrode of the fourth sub-transistor M42. A gate of the fourth sub-transistor M42 is connected to the first scan signal terminal Scan (n−1). A second electrode of the fourth sub-transistor M42 is connected to the initialization signal terminal Vi.

The first end of the storage capacitor Cst, the gate of the first transistor M1, the second electrode of the third transistor M3, and the first electrode of the fourth transistor M4 are electrically connected to each other.

Figure 6:
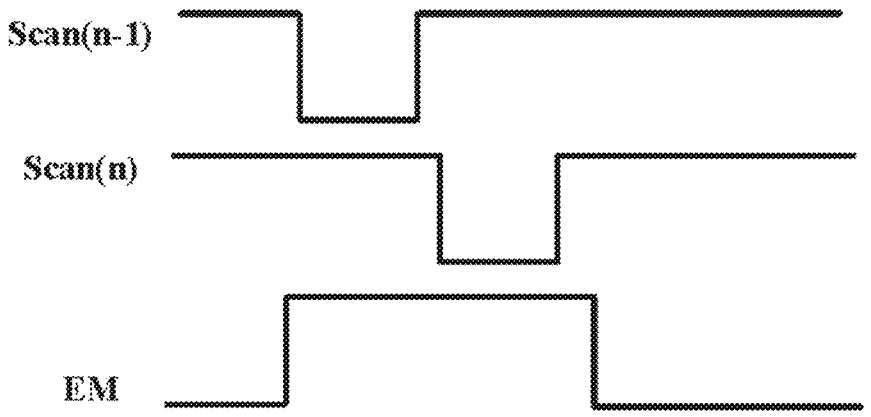
FIG. 6 is a timing diagram of the 7T1C pixel circuit shown in FIG. 5.

A timing diagram of a 7T1C pixel circuit is shown in FIG. 6. In an initialization phase, the first scan signal terminal Scan (n−1) provides a low-level signal. The fourth transistor M4 is turned on. The initialization signal Vi initializes the storage capacitor Cst through the fourth transistor M4. In a data writing stage, the second scan signal terminal Scan (n) provides a low-level signal. The second transistor M2 and the third transistor M3 are turned on. The signal provided by the data signal terminal Data charges the first end of the storage capacitor Cst until the first transistor M1 turns off. In the 7T1C pixel circuit, a conventional thin film transistor size and storage capacitor size are maintained.

Figure 7:
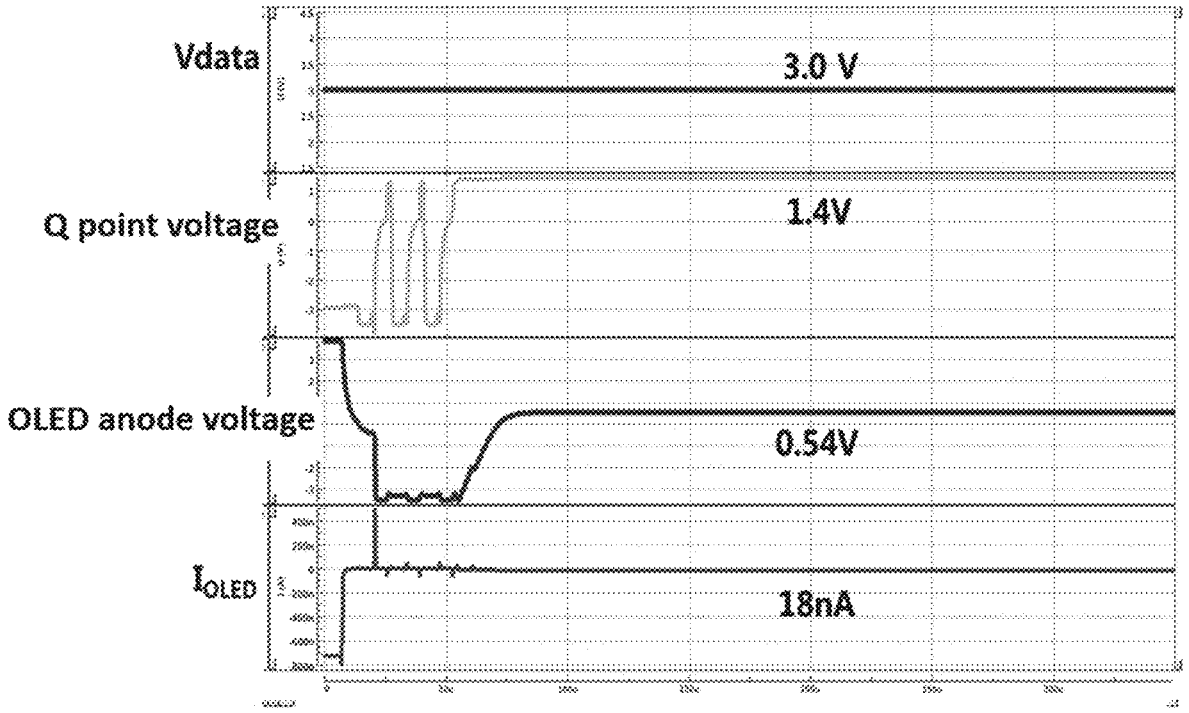
FIG. 7 is a simulation result diagram of the 7T1C pixel circuit shown in FIG. 5.

A simulation result is shown in FIG. 7. When a written Data voltage is 3.0 V, a gate voltage of the first transistor M1 reaches 1.4 V due to its Vth extraction. In the 7T1C pixel circuit, the written VDD voltage is 4.6 V, and VSS is −4.0 V. For p type TFTs, gate voltage Vgs=1.4-4.6=−3.2 V at this time, which is less than the threshold voltage Vth (about −2.5 V) of the first transistor M1. The first transistor M1 is in an on state, and the simulation result shows that the current through the OLED is 18 nA.

At the same Data written voltage, the current flowing through the OLED in the 2T1C pixel circuit differs from the current flowing through the OLED in the 7T1C pixel circuit by at least 3 orders of magnitude. That is, for the 2T1C pixel circuit, to achieve the same current value as the 7T1C pixel circuit, a smaller Data voltage needs to be written. Generally, the Data value range of the 7T1C pixel circuit is about 3.0 V-6.0 V. The data range of the corresponding 2T1C pixel circuit is about 0.5 V-3.5 V. The operating voltage of the 2T1C pixel circuit is not within the normal data voltage range given by the drive circuit, so it is not advisable to mount the 2T1C pixel circuit in the under-screen camera area.

In response to the above technical problems, applicant has provided a pixel circuit and a display panel after research, which can implement a 2T1C pixel circuit with a under-screen camera area to improve light transmittance.

Figure 8:
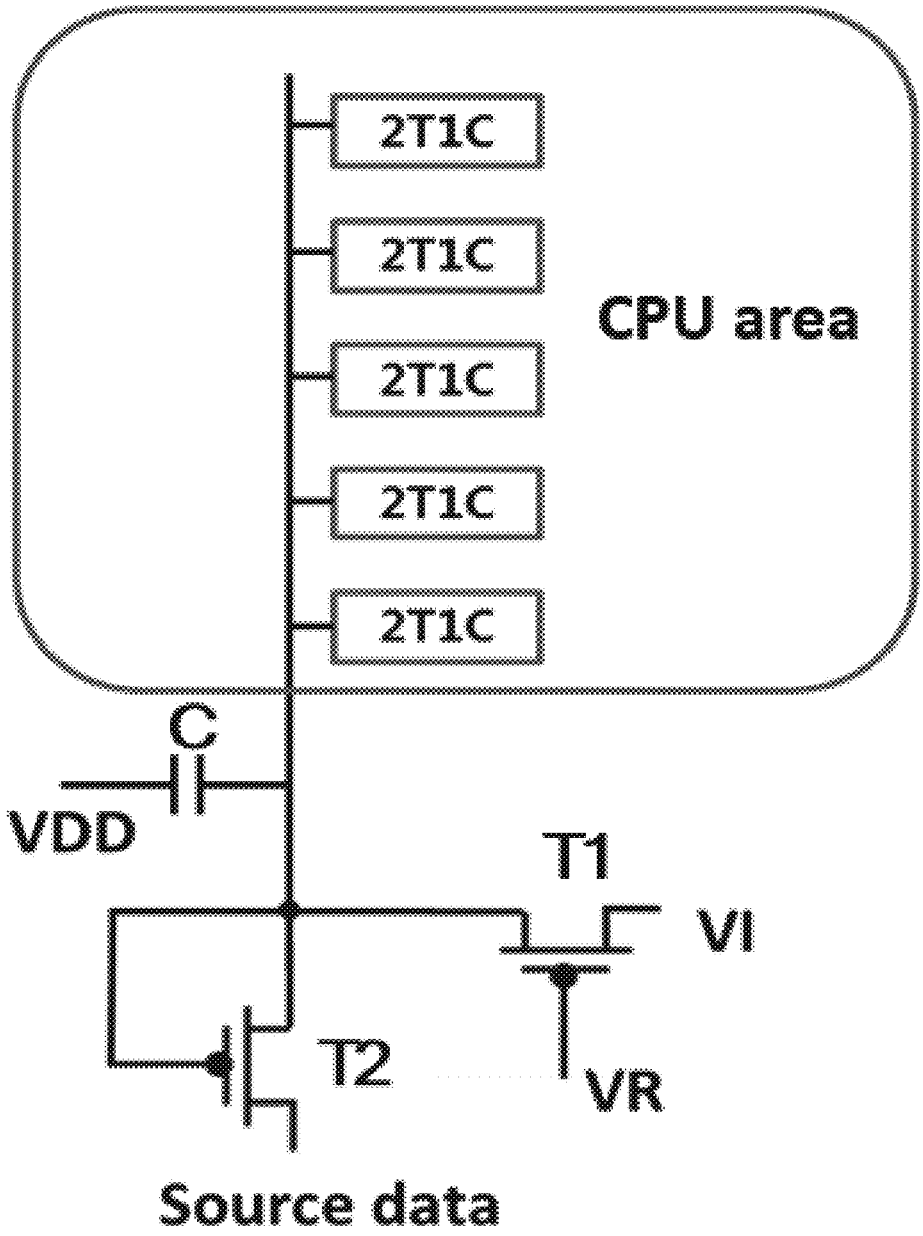
FIG. 8 is a schematic structural diagram of a pixel circuit according to an embodiment of the present invention.
Figure 9:
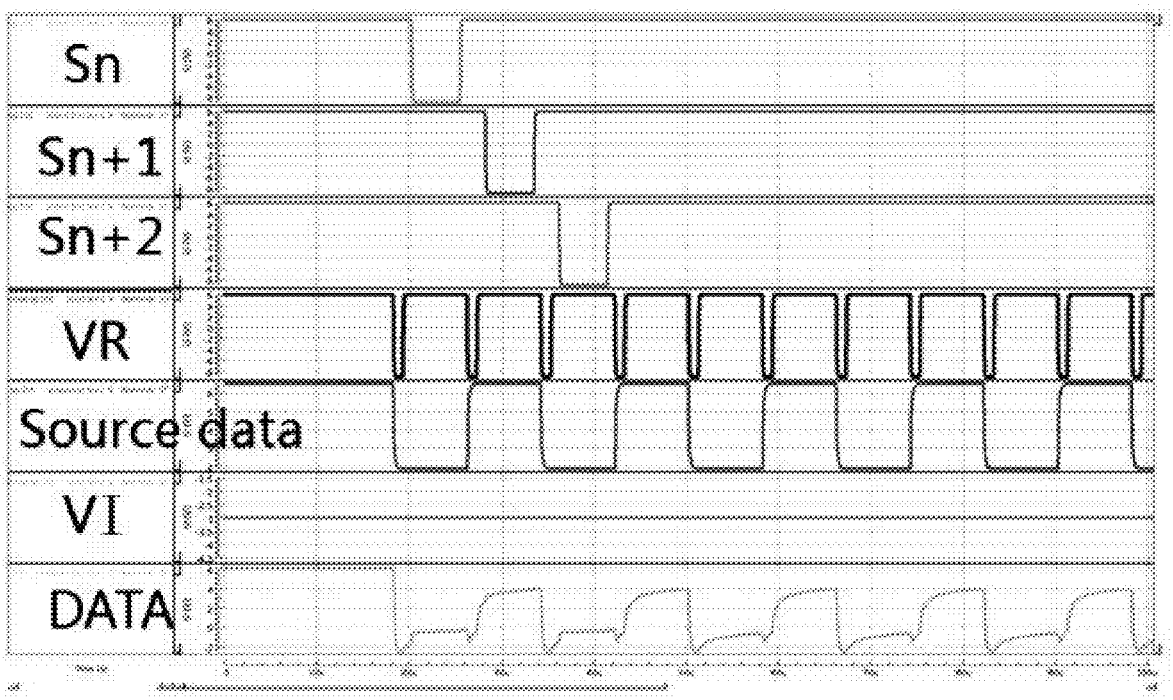
FIG. 9 is a simulation result diagram of the pixel circuit shown in FIG. 8.

Referring to FIG. 8 and FIG. 9, an embodiment of the present invention provides a pixel circuit comprising a data line, a scan line, a plurality of hierarchical 2T1C circuits, a step-down circuit, and a reset circuit. The data line is configured to transmit a source data signal. The scan line is configured to transmit a scan signal. Each input of the plurality of hierarchical 2T1C circuits is connected to the scan line in parallel. An input of the step-down circuit is connected to the data line and an output of the step-down circuit is connected to another input of each 2T1C circuit. The reset circuit is connected to the input of the step-down circuit.

Further, the reset circuit comprises a first driving transistor (T1) comprising a source configured to input a reset voltage signal (VI), a drain connected to another input of each 2T1C circuit, and a gate configured to input an AC voltage signal (VR). When the AC voltage signal (VR) is at a low level, a voltage of the reset voltage signal (VI) is written into the 2T1C circuit to reset the 2T1C circuit.

Further, the step-down circuit comprises a second driving transistor (T2) comprising a source configured to input a source data signal, and a gate and a drain connected to another input of each 2T1C circuit. That is, a gate and a drain of the second driving transistor (T2) are electrically connected to each other and to the drain of the first driving transistor (T1). The inputs of all the 2T1C pixel circuits are electrically connected to the drain of the first driving transistor (T1) and the drain of the second driving transistor (T2). When the AC voltage signal (VR) is at a low level, a voltage of the reset voltage signal (VI) is written into the 2T1C pixel circuit to reset it. When the AC voltage signal (VR) is at a high level and the scan signal (Scan (n)) of the 2T1C pixel circuit is at a low level, a voltage of the source data signal is driven by the second driving transistor (T2) to capture the threshold voltage (Vth) and write to the 2T1C pixel circuit.

Refer to FIG. 2 for a schematic structural diagram of a 2T1C pixel circuit. Refer to FIG. 9 for a simulation result of a pixel circuit. Sn, Sn+1, Sn+2 in FIG. 9 represent successive input signals of the scan signal Scan of the 2T1C pixel circuit.

In this embodiment, the reset voltage signal (VI) is a negative voltage, preferably −3V.

In this embodiment, the voltage of the source data signal is a high positive voltage, which is reduced to a low positive voltage and written into the 2T1C pixel circuit after being captured by the threshold voltage (Vth) by the second driving transistor (T2).

In this embodiment, a voltage value of the threshold voltage (Vth) of the second driving transistor (T2) is the difference between an operating voltage value of the 2T1C pixel circuit and a voltage value of the source data signal.

Specifically, the voltage of the source data signal is a high-level positive voltage 2.5 V-5.5 V. The threshold voltage (Vth) of the second driving transistor (T2) is preset to −2.5 V. After being captured by the threshold voltage (Vth), the source data signal is reduced to a low positive voltage of 0 V-3 V. The low positive voltage 0V-3V is the same as the operating voltage range of the 2T1C pixel circuit. The 2T1C pixel circuit can be directly written, so that the 2T1C pixel circuit can be implemented in the under-screen camera area, and light transmittance is improved.

The current formula of the pixel circuit is:

$$I = \frac{1}{2} u_n C_{OX} \frac{W}{L} (V_{gs} - V_{th})^2$$

Un stands for mobility, Cox stands for gate oxide capacitance, W/L stands for a width-to-length ratio of a thin film transistor channel, Vgs stands for gate voltage, and Vth stands for threshold voltage.

According to calculation and verification of the current formula of the pixel circuit, the current flowing through the organic light-emitting element OLED of the 2T1C pixel circuit is consistent with the current flowing through the organic light-emitting element OLED of the 7T1C pixel circuit. The operating voltage range of the circuit is the same as the 7T1C pixel circuit.

Figure 10:
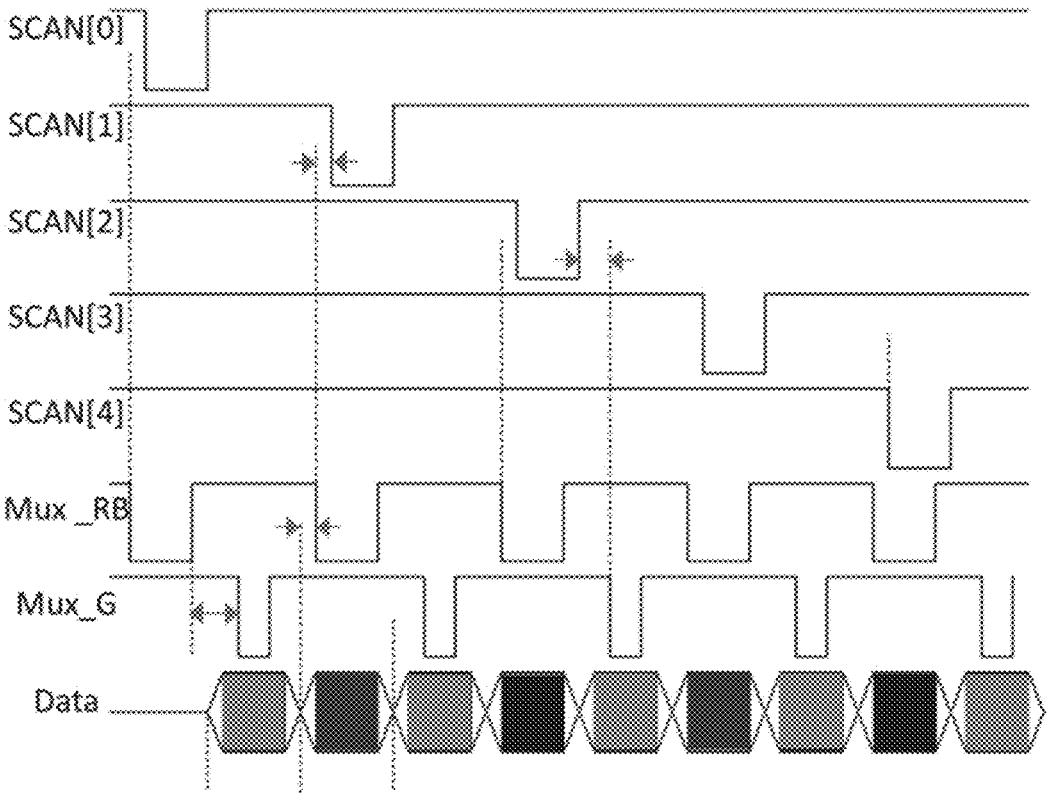
FIG. 10 is a schematic diagram showing that Mux_G signal is compatible with AC voltage signal (VR) of a 2T1C pixel circuit.

In this embodiment, timing of the AC voltage signal (VR) is set synchronously with timing of a multiplexer (Mux) signal. Understandably, the AC voltage signal (VR) may be provided by a multiplexer (Mux). Specifically, as shown in FIG. 10, the Mux_G signal is compatible with the AC voltage signal (VR) of the above 2T1C pixel circuit, and no additional signal is required from an integrated circuit (IC).

In an embodiment, the pixel circuit further comprises a voltage stabilizing capacitor (C) comprising an end electrically connected to a positive power supply voltage (VDD) and another end electrically connected to the input of the 2T1C circuit, the voltage stabilizing capacitor (C) is configured to stabilize a voltage input to the 2T1C circuit. The positive power supply voltage (VDD) is a fixed voltage, preferably 4.6 V.

Figure 11:
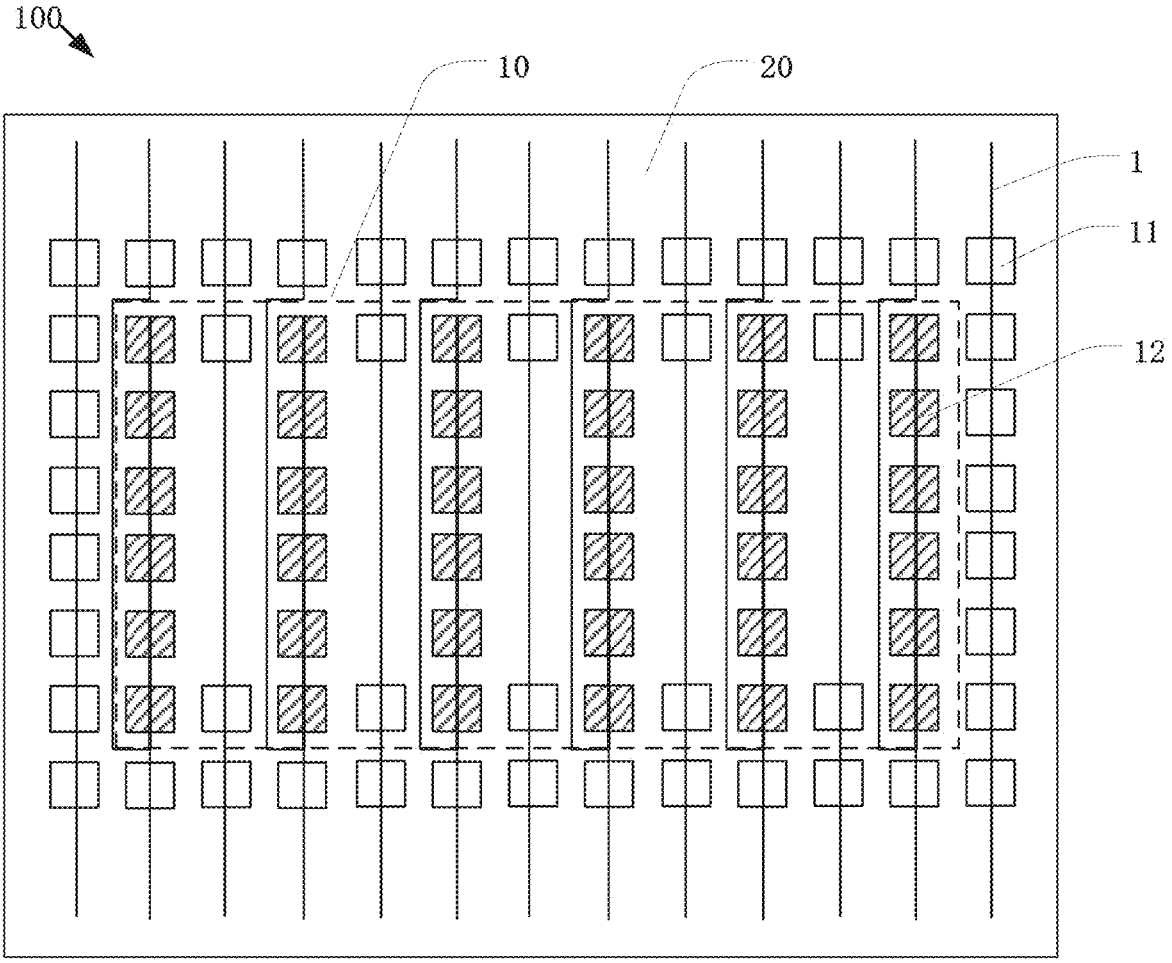
FIG. 11 is a partial schematic structural diagram of a display panel.

FIG. 11 is a partial schematic structural diagram of a display panel. Referring to FIG. 11, an embodiment of the present invention further provides a display panel 100 comprising the above pixel circuit.

The display panel 100 comprises an under-screen camera (CUP) area 10 and a display area 20 around the under-screen camera area 10, the 2T1C circuit is disposed in the under-screen camera area 10.

In an embodiment, the display area 20 includes a plurality of scan lines (not shown) extending in a first direction, a plurality of data lines 1 extending in a second direction, and a plurality of first pixel units 11 defined by two adjacent scan lines and two adjacent data lines 1. The first pixel unit 11 includes a 7T1C pixel circuit. The second direction is different from the first direction. In this embodiment, the first direction is preferably horizontal, and the second direction is longitudinal. Therefore, the display area 20 includes a plurality of data lines 1 extending longitudinally and a plurality of first pixel units 11. The input of the 7T1C pixel circuit in the first pixel unit is connected to the data line 1.

The under-screen camera area 10 includes a plurality of the data lines 1 extending along the second direction (i.e., longitudinal direction), a plurality of second pixel units 12 arranged in the longitudinal direction, and a plurality of first pixel units arranged in the longitudinal direction 11. The second pixel unit 12 includes the 2T1C pixel circuit. Each input of the plurality of second pixel units 12 is connected to the scan line, and another input of the plurality of second pixel units 12 is connected to the output of the step-down circuit. The first pixel unit 11 includes a 7T1C pixel circuit, and its input is connected to the data line 1. The second pixel units 12 arranged in the longitudinal direction and the first pixel units 11 arranged in the longitudinal direction are arranged at intervals in the horizontal direction.

According to the principle of the 2T1C pixel circuit described above, the voltage of the source data signal is a high-level positive voltage 2.5 V-5.5 V. The threshold voltage (Vth) of the second driving transistor (T2) is preset to −2.5 V. After being captured by the threshold voltage (Vth), the source data signal is reduced to a low positive voltage of 0 V-3 V. The low positive voltage 0 V-3 V is the same as the operating voltage range of the 2T1C pixel circuit. The output of the step-down circuit can be directly connected to the 2T1C pixel circuit, so that the 2T1C pixel circuit can be implemented in the under-screen camera area 10, thereby improving light transmittance of the under-screen camera area 10.

Preferably, in the under-screen camera area 10, a distribution density of the first pixel units 11 arranged in the longitudinal direction is less than a distribution density of the second pixel units 12 arranged in the longitudinal direction. More preferably, there are two first pixel units 11 arranged along the longitudinal direction, which are respectively disposed near edges of the display area 20. In this way, a light-transmitting gap can be formed between the two first pixel units 11 at positions of the data lines 1 in even rows, which can effectively improve light transmittance of the under-screen camera area 10.

In this embodiment, the display panel 100 further includes a sensor (not shown) disposed opposite to the under-screen camera area 10. A position of the sensor refers to a position of a camera 98 shown in FIG. 1. The sensor includes one or a combination of a camera sensor, a flash light, a light sensor, a breathing light sensor, a distance sensor, a fingerprint scanner sensor, a microphone sensor, or a transparent antenna sensor. Preferably, an area of the sensor is less than or equal to an area of the under-screen camera area 10.

Advantages of embodiments of the present invention are to provide a display panel 100, a display device, and a method of manufacturing the same. By changing the circuit structure of the under-screen camera area 10 in the area opposite to the sensor 7, a performance of improving light transmittance is achieved.

The above is only a preferred embodiment of the present invention. It should be noted that, for those of ordinary skill in the art, without departing from the principles of the present invention, several improvements and modifications can be made. These improvements and modifications should also be regarded as the protection scope of the present invention.

What is claimed is:

1. A pixel circuit, comprising:

a data line configured to transmit a source data signal;

a scan line configured to transmit a scan signal;

a plurality of hierarchical 2 transistors and 1 storage capacitor (2T1C) circuits, each input thereof is connected to the scan line in parallel;

a step-down circuit comprising an input connected to the data line and an output connected to the input of each 2T1C circuit;

a reset circuit connected to the output of the step-down circuit; and a voltage stabilizing capacitor comprising an end electrically connected to a positive power supply voltage and another end electrically connected to the input of the 2T1C circuit, wherein the voltage stabilizing capacitor is configured to stabilize a voltage input to the 2T1C circuit.

2. The pixel circuit according to claim 1, wherein the reset circuit comprises:

a first driving transistor comprising a source configured to input a reset voltage signal, a drain connected to the input of each 2T1C circuit, and a gate configured to input an AC voltage signal;

when the AC voltage signal is at a low level, a voltage of the reset voltage signal is written into the 2T1C circuit to reset the 2T1C circuit.

3. The pixel circuit according to claim 1, wherein the step-down circuit comprises:

a second driving transistor comprising a source configured to input a source data signal, and a gate and a drain connected to the input of each 2T1C circuit;

when the scan signal of the 2T1C circuit is at a low level, a voltage of the source data signal is captured by the second driving transistor after being thresholded to be written into the 2T1C circuit.

4. The pixel circuit according to claim 1, wherein timing of the AC voltage signal is set in synchronization with timing of a multiplexer signal.

5. A display panel comprising the pixel circuit according to claim 1.

6. The display panel according to claim 5, comprising an under-screen camera area and a display area around the under-screen camera area, wherein the 2T1C circuit is disposed in the under-screen camera area.

7. The display panel according to claim 6, wherein the under-screen camera area comprises:

a plurality of second pixel units arranged along a longitudinal direction, wherein the second pixel unit comprises the 2T1C circuit, each input of the plurality of second pixel units is connected to the scan line, and the input of the plurality of second pixel units is connected to the output of the step-down circuit; and a plurality of first pixel units arranged in the longitudinal direction, wherein the first pixel unit comprises a 7 transistors and 1 capacitor (7T1C) pixel circuit, and an input of the 7T1C pixel circuit is connected to the data line;

wherein the plurality of second pixel units arranged in the longitudinal direction and the plurality of first pixel units arranged in the longitudinal direction are arranged at intervals in the horizontal direction.

8. The display panel according to claim 7, wherein in the under-screen camera area, a distribution density of the plurality of first pixel units arranged in the longitudinal direction is less than a distribution density of the plurality of second pixels arranged in the longitudinal direction.

9. The display panel according to claim 6, wherein the display area comprises a plurality of data lines extending longitudinally and a plurality of first pixel units, the first pixel unit comprises the 7T1C pixel circuit, and the input of the 7T1C pixel circuit is connected to the data line.

* * * * *